US006439879B1

(12) United States Patent
Hsu

(10) Patent No.: US 6,439,879 B1
(45) Date of Patent: Aug. 27, 2002

(54) SAFETY GAS BURNER

(76) Inventor: Huang-Hsi Hsu, 8F., No. 14, Lane 252, Chungshan N. Rd., Sec. 6, Taipei (TW)

( * ) Notice: Subject to any disclaimer, the term of this patent is extended or adjusted under 35 U.S.C. 154(b) by 0 days.

(21) Appl. No.: 09/768,343

(22) Filed: Jan. 25, 2001

(30) Foreign Application Priority Data

Dec. 7, 2000 (TW) ..... 089221263 U

(51) Int. Cl.[7] ..... F23D 11/36
(52) U.S. Cl. ..... 431/153; 431/255
(58) Field of Search ..... 431/153, 255, 431/277, 344; 222/153.14; 126/25 B, 404, 407, 414

(56) References Cited

U.S. PATENT DOCUMENTS 5,496,169 A * 3/1996 Chen ..... 431/153
5,697,775 A * 12/1997 Saito et al. ..... 431/153
5,931,656 A * 8/1999 Kanno ..... 431/153
6,059,563 A * 5/2000 Hsu ..... 431/153
6,244,858 B1 * 6/2001 Wang ..... 431/153
6,293,782 B1 * 9/2001 Tsai ..... 431/153

* cited by examiner

*Primary Examiner*—Henry Bennett
*Assistant Examiner*—Josiah C. Cocks
(74) *Attorney, Agent, or Firm*—Bacon & Thomas, PLLC

(57) ABSTRACT

A safety gas burner. The burner includes a shell having a front extension tube, a metal flame tube mounted in the front extension tube, a butane well, a gas valve adapted to control output of fuel gas from the butane well, a gas lever pivoted to the gas valve and adapted to open the gas valve for output of fuel gas from the butane well. An igniter is mounted in the shell, and the igniter includes a first terminal connected to the flame tube by a conductor and a second terminal connected to a spark discharging electrode suspended in the flame tube.

3 Claims, 4 Drawing Sheets

SAFETY GAS BURNER

BACKGROUND OF THE INVENTION

The present invention relates to gas burners and, more specifically, to a safety gas burner.

A regular gas burner 1, as shown in FIG. 1, comprises a substantially rectangular shell 10, a front extension tube 40 forwardly extended from one end of the shell 10, a metal flame tube 41 mounted in the front extension tube 40, a butane well 11 and an igniter 12 and an actuating device 13 respectively mounted inside the shell 10, a gas valve 111 mounted in the top outlet of the butane well 11, a flexible gas tube 112 extended from the gas valve 111 to the free end of the front extension tube 40 and connected to a spark discharging electrode 31, which is connected to one terminal 122 of the igniter 12 by a conductor, a gas lever 113 coupled to the gas valve 111, an ignition switch button 16 mounted in a through hole 21 of the shell 10 and stopped against the igniter 12, a safety button 14 supported on a spring 141 in a locating hole 18 of the shell 10, and a link 17 supported on a spring 171 at the actuating member 13. When operating the gas burner, the safety button 14 is depressed to move the actuating member 13 and the link 17 to such position that the link 17 is aligned between a rod 161 of the ignition switch button 16 and the gas lever 113, and then the ignition switch button 16 is depressed to force the rod 161 against the link 17 and to drive the igniter 12, causing the link 17 to drive the gas lever 113 to open the gas valve 111 and the igniter 12 to discharge sparks through the spark discharging electrode 31, and therefore fuel gas is discharged to the flame tube 41 and burned by the sparks discharged through the spark discharging electrode 31. If the user does not depress the safety button 14, depressing the ignition switch button 16 simply drives the igniter 12 to discharge sparks through the spark discharging electrode 31 without causing the gas lever 113 to open the gas valve 111, therefore no fuel gas is provided to the flame tube 41. However, this structure of gas burner is still not safe in use. Because the safety button 14 is exposed to the outside of the shell 10, the child playing the gas burner can easily found the presence of the safety button 14 and operate it, and a flame may be produced accidentally.

SUMMARY OF THE INVENTION

The present invention has been accomplished to provide a safety lock for gas burner, which eliminates the aforesaid problem. It is main object of the present invention to provide a safety burner, which uses a spring-supported stop member to stop the safety button from operation. It is another object of the present invention to provide a safety burner, in which the contact area of the stop member to the safety button is concealed from sight, so that the child cannot easily find the way to unlock the safety button when playing the safety gas burner. According to the present invention, the safety button has a mushroom-like cap, the shell has a sliding slot disposed adjacent to the safety button and holding a spring-supported stop member. Normally, the stop member is stopped between the cap of the safety button and the outside wall of the shell to stop the safety button from operation. When in use, the stop member is moved downwards in the sliding slot and disengaged from the safety button, enabling the safety button to be operated.

DETAILED DESCRIPTION OF THE PREFERRED EMBODIMENT

Figure 1:
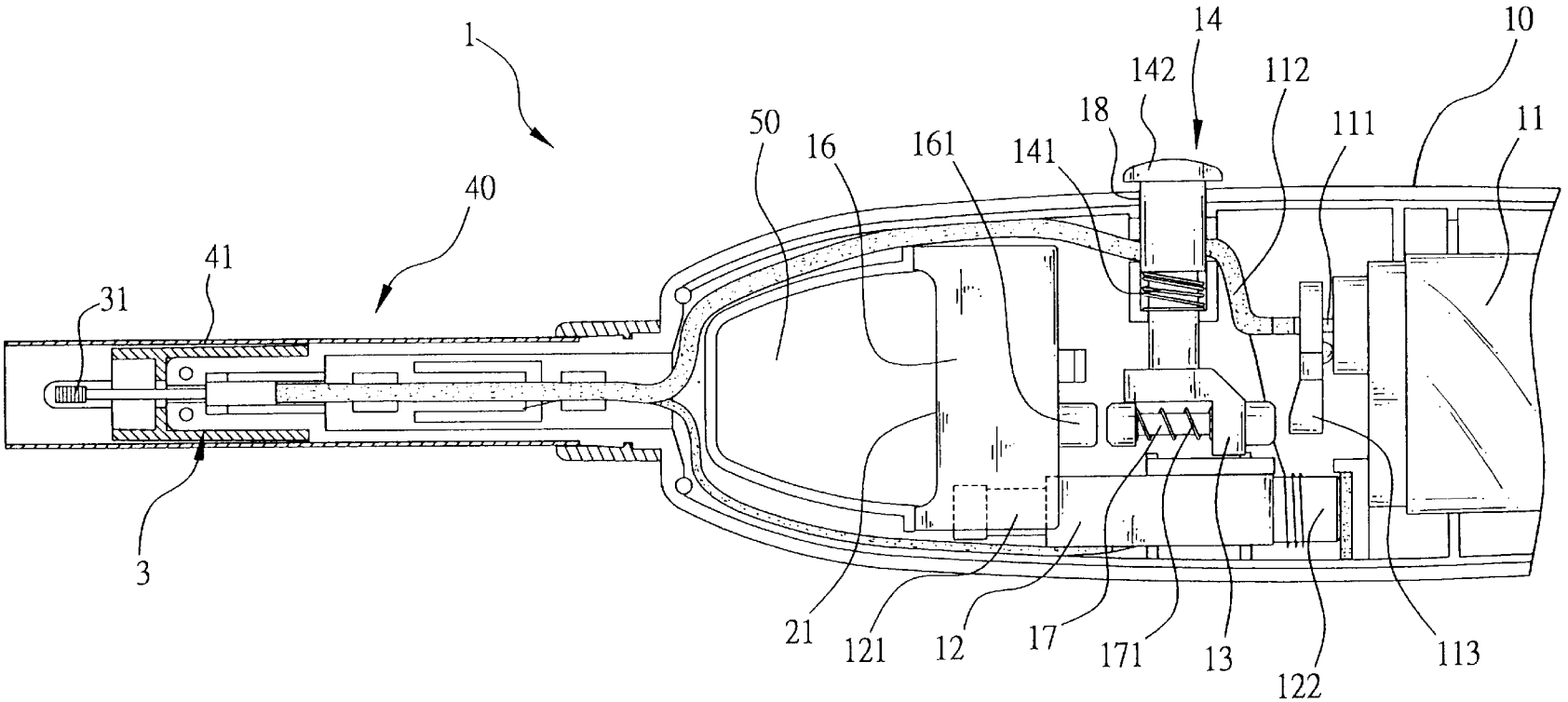
FIG. 1 (Prior Art)
FIG. 1 is a plain view of a gas burner according to the prior art.
Figure 2:
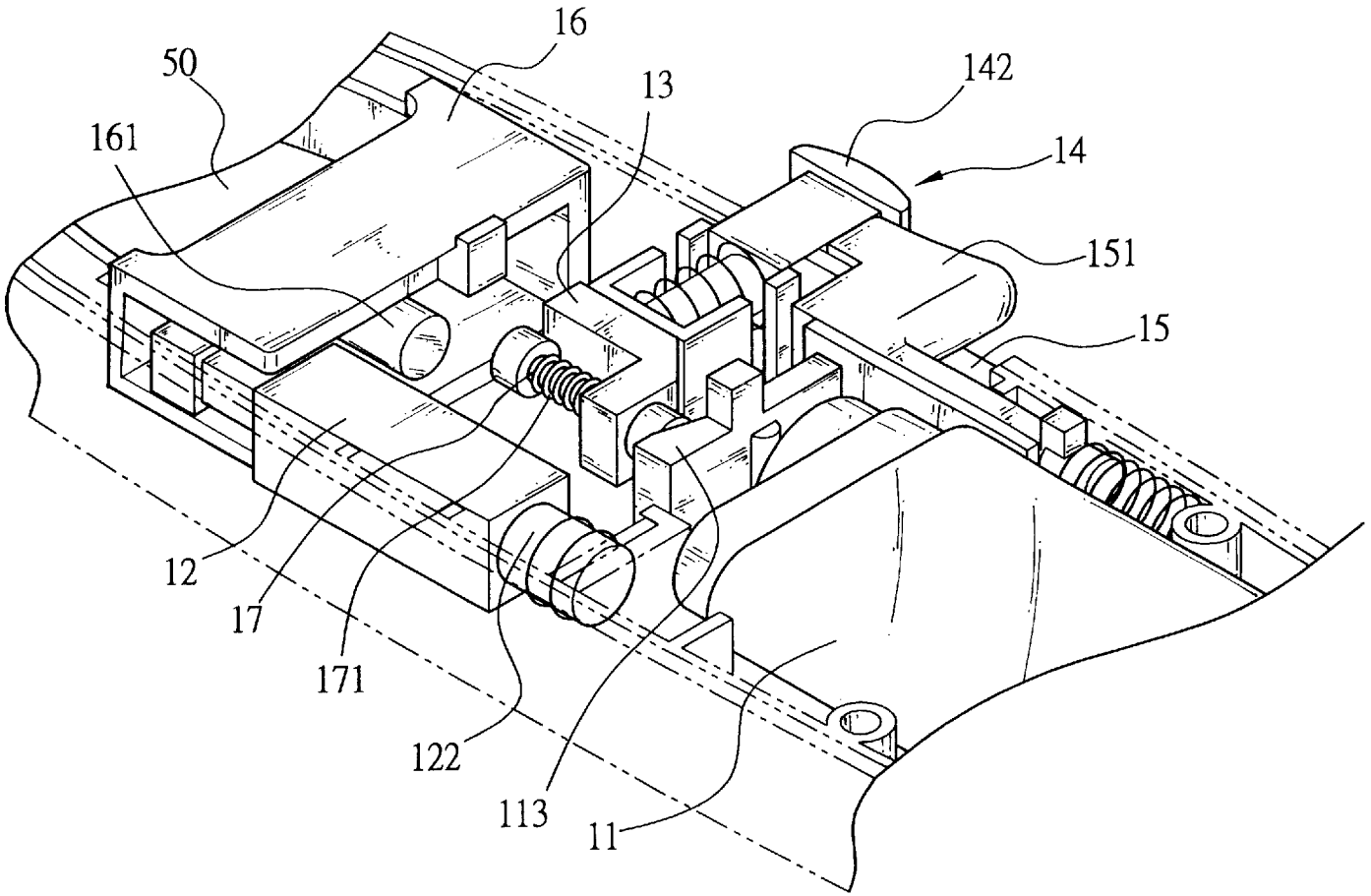
FIG. 2 is a perspective view of the present invention.
Figure 3:
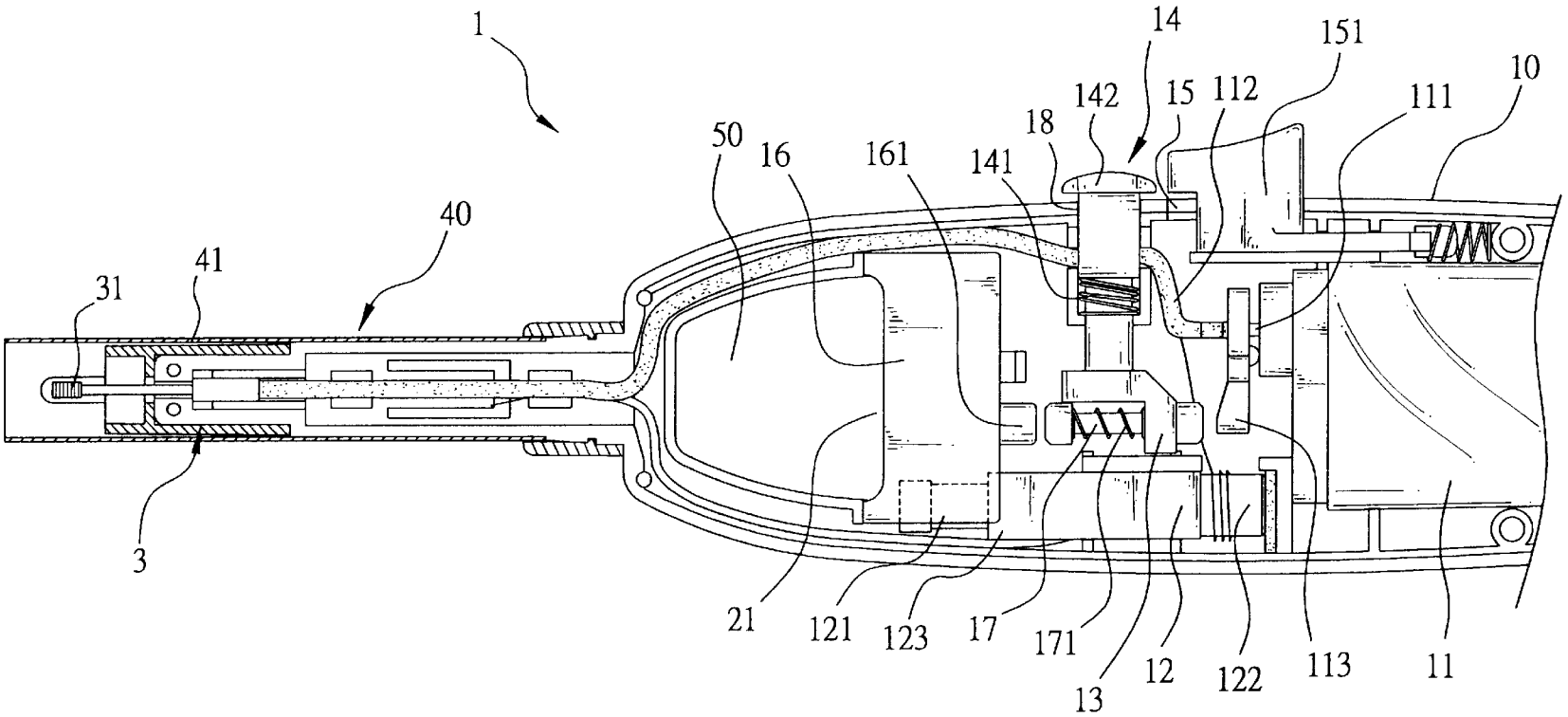
FIG. 3 is a plain view of the present invention showing the stop member disengaged from the safety button.

Referring to FIGS. 2 and 3, the gas burner 1 is shown comprising a substantially rectangular shell 10, a front extension tube 40 forwardly extended from one end of the shell 10, a metal flame tube 41 mounted in the front extension tube 40, a butane well 11 and an igniter 12 and an actuating device 13 respectively mounted inside the shell 10, a gas valve 111 mounted in the top outlet of the butane well 11, a flexible gas tube 112 extended from the gas valve 111 to the free end of the front extension tube 40 and connected to a spark discharging electrode 31, which is connected to one terminal 122 of the igniter 12 by a conductor, a gas lever 113 coupled to the gas valve 111, an ignition switch button 16 mounted in a through hole 21 of the shell 10 and stopped against the igniter 12, a safety button 14 supported on a spring 141 in a locating hole 18 of the shell 10, the safety button 14 having one end connected to the actuating member 13 by a screw joint and an opposite end extended out of the shell 10 and provided with a mushroom-like cap 142, a link 17 supported on a spring 171 at the actuating member 13, and a spring-supported stop member 151 mounted in a sliding slot 15 of the shell 10 and stopped between the outside wall of the shell 10 and the cap 142 of the safety button 14 to stop the safety button 14 from operation.

Referring to FIG. 3 again, when operating the gas burner, the spring-supported stop member 151 is moved downwards from the top end of sliding slot 15 to the bottom end thereof and disengaged from the cap 142 of the safety button 14 to unlock the safety button 14, and then the safety button 14 is depressed to move the actuating member 13 and the link 17 to such position that the link 17 is aligned between a rod 161 of the ignition switch button 16 and the gas lever 113, and then the ignition switch button 16 is depressed to force rod 161 of the ignition switch button 16 and the gas lever 113, and then the ignition switch button 16 is depressed to force the rod 161 against the link 17 and to drive the igniter 12, causing the link 17 to drive the gas lever 113 to open the gas valve 111 and the igniter 12 to discharge sparks through the spark discharging electrode 31, and therefore fuel gas is discharged to the flame tube 41 and burned by the sparks discharged through the spark discharging electrode 31.

Figure 4:
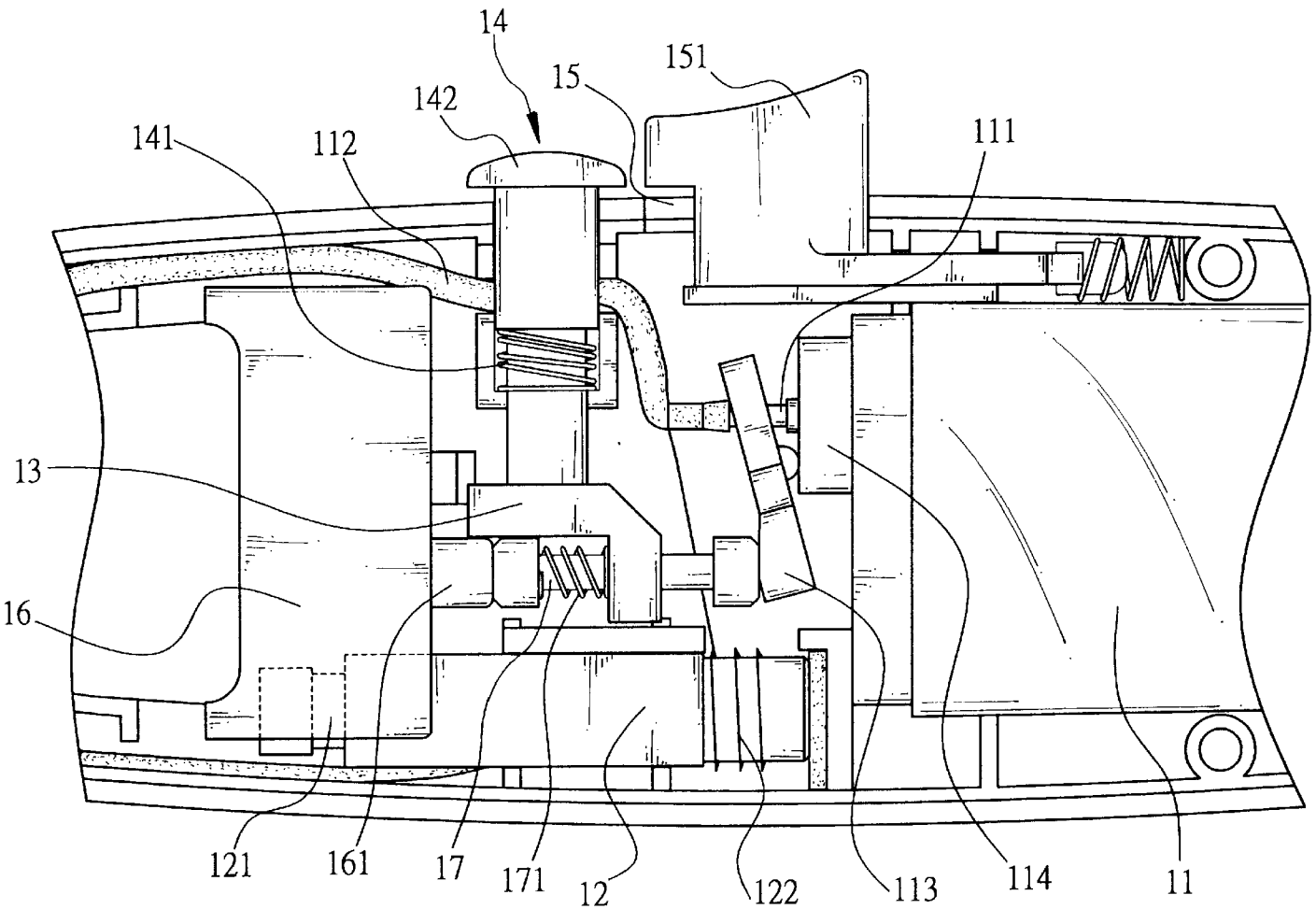
FIG. 4 is another plain view of the present invention, showing the stop member disengaged from the safety button.

Referring to FIG. 4 and FIG. 3 again, the gas lever 113 is pivoted to the gas valve 111, and the gas outlet of the gas valve 111 is connected to flame tube 41 adjacent to the spark-discharging electrode 31. When forcing the link 17 against one end of the gas lever 113, the other end of the gas lever 113 is lifted to open the gas valve 111, enabling fuel gas to flow from the butane well 11 through the flexible gas tube 112 to the area around the spark discharging electrode 31 for burning. A flame adjustment wheel 114 is coupled to the gas valve 111, and adapted to control the flow rate of fuel gas passing out of the gas valve 111.

Referring to FIG. 3 again, the ignition switch button 16 is mounted in the through hole 21 of the shell 10 and stopped against the igniter 12. An opening 50 is made through the shell 10 in communication with the through hole 21. The user can insert the thumb into the opening 50 to operate the ignition switch button 16. The igniter 12 is mounted inside the shell 10 and stopped against the bottom end of the ignition switch button 16, having one terminal 122 connected to the spark discharging electrode 31 by a conductor (not shown), and the other terminal 123 connected to the flame tube 41 by a conductor (not shown). When depressing the ignition switch button 16 to drive the igniter 12, an electric arc is produced between the flame tube and the spark-discharging electrode 31. The igniter 12 is supported on spring means (not shown), which automatically returns the igniter 12 to its former position after each operation of the ignition switch button 16.

By means of the aforesaid arrangement, the user must move the spring-supported stop member 151 from the top end of sliding slot 15 to the bottom end thereof to unlock the safety button 14 upon each use of the gas burner, so that the safety button 14 can be depressed to move the actuating member 13 and the link 17 to the operative position. After the actuating member 13 and the link 17 have been moved to the operative position, the ignition switch button 16 is depressed to open the gas valve 111 and to simultaneously trigger the igniter 12.

Referring to FIG. 2 again, the cap 142 of the safety button 14 is shaped like a mushroom, and the stop member 151 is retained between the cap 142 of the safety button 14 and the outside wall of the shell 10. Viewing from the outside, a child cannot easily find that the stop member 151 and the safety button 14 are two separate members and can be separated from each other. Therefore, when playing the gas burner, the child does not know the way to unlock the safety button 14.

While only one embodiment of the present invention has been shown and described, it will be understood that various modifications and changes could be made thereunto without departing from the spirit and scope of the invention disclosed.

What the invention claimed is:

1. A safety gas burner comprising:

a shell, said shell comprising a front extension tube forwardly extended from a front end thereof, a metal flame tube mounted in said front extension tube, a butane well, a gas valve adapted to control output of fuel gas from said butane well, a gas lever pivoted to said gas valve and adapted to open said gas valve for output of fuel gas from said butane well;

an igniter mounted in said shell, said igniter having a first terminal connected to said flame tube by a conductor and a second terminal connected to a spark discharging electrode suspended in said flame tube;

an ignition switch button mounted in a through hole of said shell and stopped against said igniter and adapted for depressing by hand to trigger said igniter and to drive said gas lever to open said gas valve;

a safety button supported on a spring in a locating hole of said shell and adapted to let said gas lever be driven by said ignition switch button when depressed, said safety button having a cap disposed outside said shell; and a spring-supported stop member mounted in a sliding slot of said shell and stopped between an outside wall of said shell and the cap of said safety button to stop said safety button from operation.

2. The safety gas burner of claim 1 further comprising an actuating member link connected to one end of said safety button inside said shell, and a link supported on a spring at said actuating member link and adapted to drive said gas lever upon depression of said ignition switch button after said safety button has been depressed.

3. The safety gas burner of claim 1, further comprising a flame adjustment wheel pivoted to said gas valve and adapted to control the flow rate of fuel gas discharged from said gas valve.

* * * * *